US011141010B1

(12) United States Patent
Mitchell

(10) Patent No.: US 11,141,010 B1
(45) Date of Patent: Oct. 12, 2021

(54) WEDGE SHAPED UNITARY LATERAL SUPPORT CUSHION

(71) Applicant: Cuddle Buddy LLC, Raytown, MO (US)

(72) Inventor: Aaron Christopher Mitchell, Raytown, MO (US)

( * ) Notice: Subject to any disclaimer, the term of this patent is extended or adjusted under 35 U.S.C. 154(b) by 0 days.

(21) Appl. No.: 16/837,241

(22) Filed: Apr. 1, 2020

Related U.S. Application Data

(60) Provisional application No. 62/831,862, filed on Apr. 10, 2019.

(51) Int. Cl.
*A47G 9/10* (2006.01)

(52) U.S. Cl.
CPC .... *A47G 9/1072* (2013.01); *A47G 2009/1018* (2013.01)

(58) Field of Classification Search
CPC ..... A47G 9/1072; A47G 2009/1018
See application file for complete search history.

(56) References Cited

U.S. PATENT DOCUMENTS 3,243,828 A * 4/1966 McCarty ..... A47G 9/109 5/636
D356,919 S 4/1995 Nadeau
2,099,977 A 1/1996 Harris
5,479,667 A 1/1996 Nelson et al.
5,537,702 A 7/1996 Brown-Milants et al.
5,987,675 A 11/1999 Kim
6,052,847 A 4/2000 Allyn et al.
6,141,807 A 11/2000 Tapper
D442,006 S * 5/2001 Miller ..... D6/601
D500,622 S 1/2005 Owen
6,957,462 B1 10/2005 Wilcox
7,013,512 B1 * 3/2006 Hsu ..... A47G 9/1081 5/636
7,020,918 B1 4/2006 Tinsley
7,210,179 B2 5/2007 Kidwell
7,661,163 B1 2/2010 Gallaher
7,665,165 B2 2/2010 Maganov
8,065,766 B1 11/2011 Fierro
8,069,515 B1 12/2011 Tingey
(Continued)

OTHER PUBLICATIONS

US 8,185,768 B2, 05/2012, Kim et al. (withdrawn)
(Continued)

*Primary Examiner* — Eric J Kurilla
(74) *Attorney, Agent, or Firm* — Shook, Hardy & Bacon LLP; Keith J. Bae

(57) ABSTRACT

Aspects herein relate to a wedge shaped lateral support cushion that facilitates a side resting position for a user. The wedge shaped lateral support cushion in accordance with aspects herein is a unitary structure that is configured to support the head and the upper torso area of the user. In order to provide a proper alignment of the user's body in the side resting position, the wedge shaped lateral support cushion comprises a nook that is configured to receive the shoulder of the user so that the user has full range of motion of the arm that corresponds to the shoulder that is in accommodated in the nook. As such, the user can remain in the side resting position for prolonged periods of time, and can perform activities such as side sleeping, cuddling with a partner, lounging, and the like.

8 Claims, 8 Drawing Sheets

(56) References Cited

U.S. PATENT DOCUMENTS

| | | | | |
|---|---|---|---|---|
| D659,252 | S | 5/2012 | Batiste et al. | |
| 8,474,079 | B1 | 7/2013 | Gangitano | |
| D736,541 | S | 8/2015 | Maldonado | |
| 9,510,686 | B2 | 12/2016 | Abraham | |
| D809,825 | S | 2/2018 | Clores | |
| 9,943,179 | B1 | 4/2018 | May et al. | |
| 2005/0172408 | A1* | 8/2005 | Temple | A47G 9/10 5/633 |
| 2005/0193493 | A1* | 9/2005 | Gabbay | A61G 13/1215 5/644 |
| 2011/0056503 | A1* | 3/2011 | Abraham | A47C 20/026 128/845 |
| 2011/0296615 | A1* | 12/2011 | Tingey | A47C 20/023 5/632 |
| 2018/0344042 | A1 | 12/2018 | Melcher et al. | |

OTHER PUBLICATIONS

"MedCline Reflux Relief System," MedCline, medcline.com, Feb. 15, 2015. https://web.archive.org/web/20190215155110/http://www.medcline.com/products.php?product=MedCline-Reflux-Relief-System.

"Side Lying Positioning System," Oakworks Medical, oakworksmed.com, Catalog #: 59224-Txx, Feb. 15, 2019. https://web.archive.org/web/20190215060642/https://www.oakworksmed.com/side-lying-positioning-system.asp.

"SRSS Shoulder Pillow Medium," Amazon, amazon.com, ASIN: B06XPP4SZY, Feb. 15, 2019. https://web.archive.org/web/20190215064739/https://www.amazon.com/SRSS-Shoulder-Pillow-Medium/dp/B06XPP4SZY.

* cited by examiner

WEDGE SHAPED UNITARY LATERAL SUPPORT CUSHION

CROSS-REFERENCE TO RELATED APPLICATIONS

This Application entitled "Wedge Shaped Unitary Lateral Support Cushion," claims the benefit of priority of U.S. Provisional Application 62/831,862, filed on Apr. 10, 2019, and entitled "Wedge Shaped Unitary Lateral Support Cushion," the entirety of which is incorporated by reference herein.

TECHNICAL FIELD

Aspects herein are related to a lateral support cushion that facilitates a side resting position for a user.

BACKGROUND

Traditional cushions or pillows comprise an even height, which is not ideal for a side resting position of a user. For example, although a user may use one tall cushion or stack two or more cushions to adjust the height, this still may cause undesirable strain of the neck and shoulder muscles of the user. Further, in this position, after a given amount of time, the user may experience pressure pain around his/her shoulder, upper arm, and back area. Therefore, making it difficult to stay in the side resting position for prolonged periods of time. Particularly when cuddling with a partner, child, pet, and the like.

DESCRIPTION OF THE DRAWINGS

Examples of aspects herein are described in detail below with reference to the attached drawing figures, wherein.

DETAILED DESCRIPTION

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a lateral support cushion or, in other words, a support cushion for a side resting position of a user. The lateral support cushion comprises a unitary construction meaning that it is formed as a single piece. Further, the lateral support cushion comprises a general wedge shape having a nook proximate the tall end of the wedge. The nook proximate the tall end of the wedge is configured to receive a shoulder portion of the user when the user lays down on his/her side on the lateral support cushion in accordance with aspects herein. The lateral support cushion in accordance with aspects herein offers many advantages to those users who like to lay down on their side for resting, sleeping, lounging, cuddling, or the like, or would otherwise benefit from laying on their side such as, during pregnancy. Further, because of its wedge shape, the lateral support cushion in accordance with aspects herein, can also be used as a wedge pillow to prop the user's upper torso at an angle to alleviate from ailments such as acid reflux. Additionally, the pillow may be propped on its rear plane with the incline facing the user to provide lumbar support when sitting in an upright position, or in other aspects, the lateral support cushion may also be used to incline the leg(s) of a user to relieve fatigue. Many more advantages are contemplated such as for providing support while the user is laying down on their belly so that the user can have unobstructed range of motion to his/her arms such that he/she can engage with a pet, toy, book, child, or the like. Further, the lateral support cushion in accordance with aspects herein, may be used on hard surfaces such as floors (carpeted or not), or soft surfaces such as a mattresses, sofas (i.e. couches), and the like.

Figure 1A:
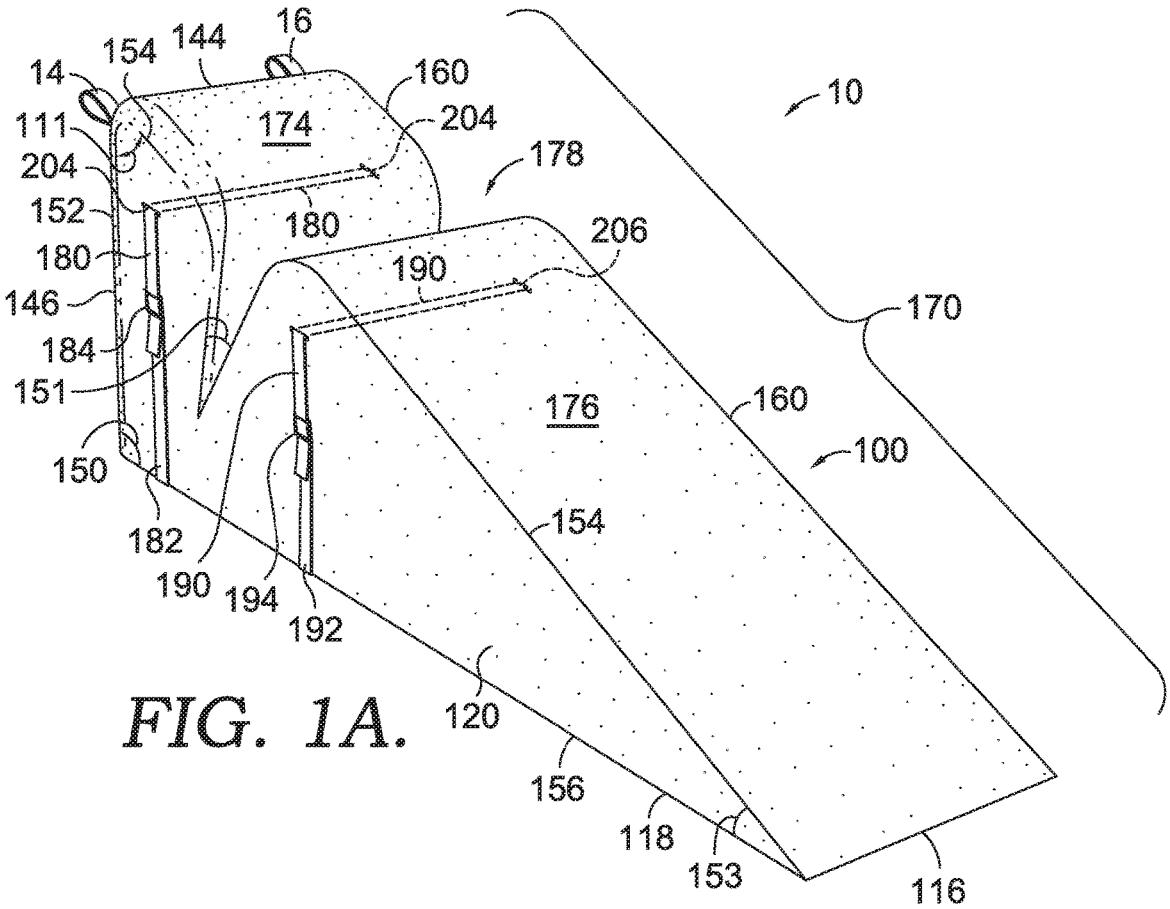
FIG. 1A illustrates a perspective view of a wedge shaped unitary lateral support cushion in accordance with aspects herein.
Figure 1B:
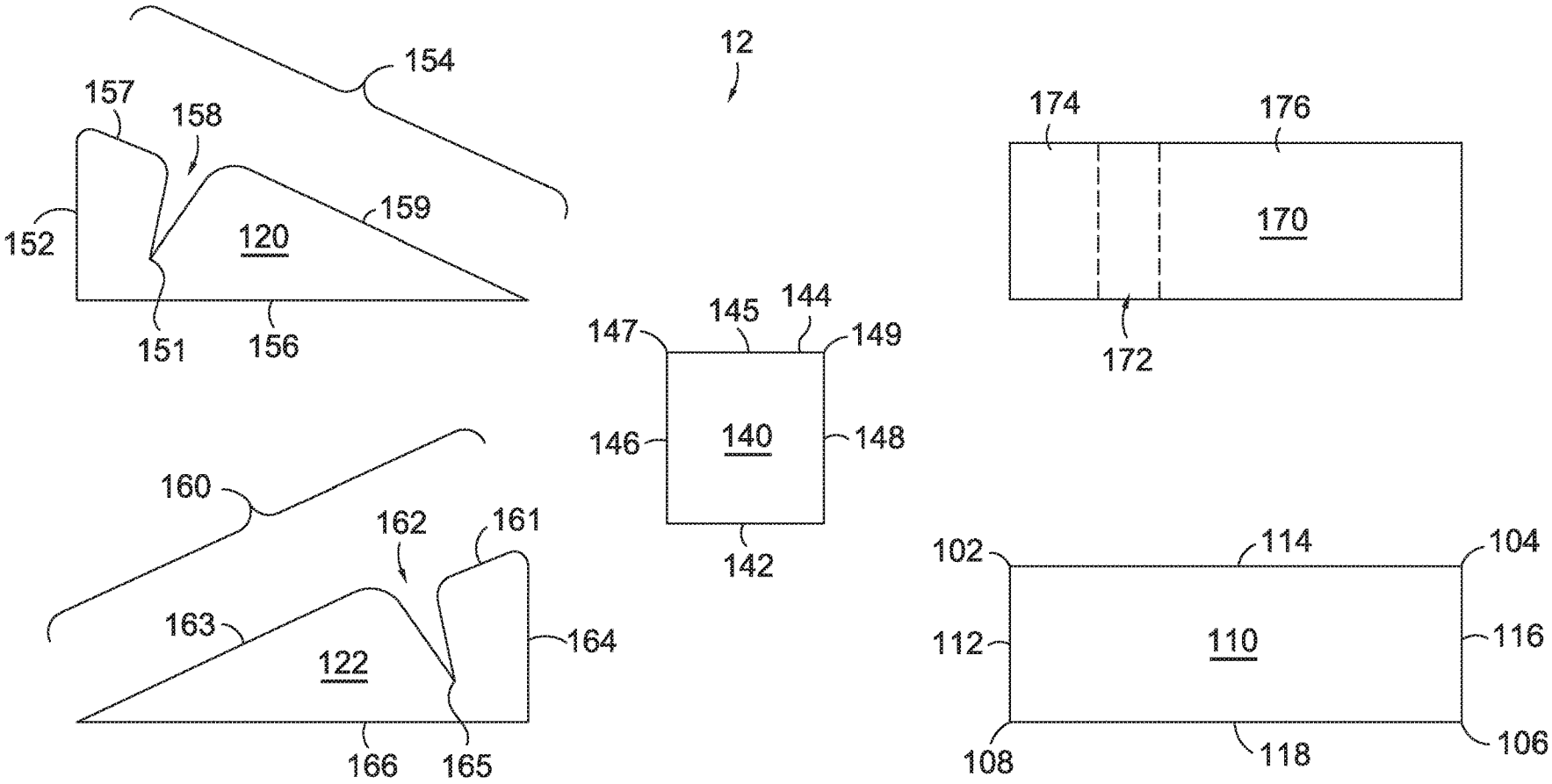
FIG. 1B illustrates a deconstructed view of the wedge shaped unitary lateral support cushion in accordance with aspects herein.

Moving on to the figures, FIGS. 1A and 1B shows a perspective view 10 and a deconstructed view 12, respectively, of an exemplary wedge shaped unitary lateral support cushion 100. As shown, the wedge shaped unitary lateral support cushion 100 comprises a base plane 110 comprising a first vertex 102, a second vertex 104, a third vertex 106, and a fourth vertex 108, where a first edge 112 of the base plane 110 extends between the first vertex 102 and the fourth vertex 108. A second edge 114 of the base plane 110 extends from the first vertex 102 to the second vertex 104. A third edge 116 of the base plane 110 extends from the second vertex 104 to the third vertex 106. Finally, a fourth edge 118 extends from the third vertex 106 to the fourth vertex 108. Although the physical characteristics of the wedge shaped unitary lateral support cushion 100 are described using vertices and edges, it is also contemplated that the edges may be curved edges and the vertices may be rounded and not necessarily pointed or straight, as depicted in the drawings.

Further, the wedge shaped unitary lateral support cushion 100 comprises a rear plane 140 having a rear inferior edge 142, a rear superior edge 144, a rear first side edge 146, and a rear second side edge 148. The rear plane 140 upwardly extends from the first edge 112 of the base plane 110 with the rear inferior edge 142 of the rear plane 140 abutting the first edge 112 of the base plane 110. As shown, the rear plane 140 upwardly extends from the first edge 112 of the base plane 110 at an angle 150 that is a substantially orthogonal angle (90° angle). By substantially, in accordance with aspects herein, it is meant that the angle 150 is at most ±10° from a 90° angle, at most ±7° from a 90° angle, or at most ±4° from a 90° angle. Similarly, the inclined plane 170 extends from the rear superior edge 144 of the rear plane 140 at an angle 111 with the first portion 174 of the inclined plane 170 abutting the rear superior edge 144 of the rear plane 140. Angle 111 may be between a 50° angle and an 80° angle (e.g., a 55° angle, a 58° angle, a 60° angle, a 62° angle, a 64° angle, a 66° angle, a 67.9° angle, a 70° angle, a 75° angle, an angle that is between 60° and 70°, and the like.

Furthermore, the wedge shaped unitary lateral support cushion 100 comprises a first side plane 120 and a second side plane 122. The first side plane 120 has a first side edge 152, a first side inclined edge 154 having a first recess 158 proximate to the first side edge 152, and a first side inferior edge 156. In other words, the first side inclined edge 154 continuously extends from a head support section 157 to a body support section 159 with the first recess 158 optionally including an angle 151 that may be equal to or smaller than a 60° angle (e.g., a 5° angle, a 10° angle, a 12° angle, a 12.6° angle, a 13° angle, an angle that is between 10° and 15°, a 15° angle, a 20° angle, a 25° angle, a 30° angle, a 35° angle, a 40° angle, a 45° angle, a 50° angle, a 55° angle, and the like, that is between a 1° angle and a 60° angle). In accordance with other aspects, instead of the first recess 158 including the angle 151 (as shown), the first recess 158 may include a concave or rounded base (not shown), that is also within aspects of the present invention. As further shown, the first side plane 120 upwardly extends from the fourth edge 118 of the base plane 110, the first side inferior edge 156 abutting the fourth edge 118 of the base plane 110 and the first side edge 152 abutting the rear first side edge 146 of the rear plane 140. Similarly, the second side plane 122 has a second side edge 164, a second side inclined edge 160 having a second recess 162 proximate to the second side edge 164, and a second side inferior edge 166. In other words, the second side inclined edge 160 continuously extends from a head support section 161 to a body support section 163 with the second recess 162 optionally including an angle 165 that like the angle 151 included in the first recess, may be equal to or smaller than a 60° angle (e.g., a 5° angle, a 10° angle, a 12° angle, a 12.6° angle, a 13° angle, an angle that is between 10° and 15°, a 15° angle, a 20° angle, a 25° angle, a 30° angle, a 35° angle, a 40° angle, a 45° angle, a 50° angle, a 55° angle, and the like, that is between a 1° angle and a 60° angle) to correspond to the angle 151. As well, in accordance with other aspects, like the second side inclined edge 160, instead of the second recess 162 including the angle 165 (as shown), the second recess 162 may include a concave or rounded base to correspond to a concave or rounded base of the first side inclined edge 154 (not shown). The second side plane 122 upwardly extends from the second edge 114 of the base plane 110 with the second side inferior edge 166 abutting the second edge 114 of the base plane 110 and the second side edge 164 abutting the rear second side edge 148 of the rear plane 140.

Additionally, the wedge shaped unitary lateral support cushion 100 further comprises an inclined plane 170 having a gap 172 between the first portion 174 (forming a head support section) and a second portion 176 (forming a body support section) of the inclined plane 170. The inclined plane 170 abuts the third edge 116 of the base plane 110 forming an angle 153 that may be between a 1° angle and a 50° angle (e.g., a 5° angle, a 10° angle, a 15° angle, a 20° angle, a 12° angle, a 12.6° angle, a 13° angle, a 23.6° angle, an angle that is between 10° and 24°, a 25° angle, a 30° angle, a 35° angle, a 40° angle, a 45° angle, a 50° angle, and the like that is between a 1° angle and a 50° angle), the rear superior edge 144 of the rear plane 140, the first side inclined edge 154 of the first side plane 120, and the second side inclined edge 160 of the second side plane 122. The gap 172 aligns with the first recess 158 of the first side plane 120 and the second recess 162 of the second side plane 122. In other words, the first recess 158 and the second recess 162 are aligned with each other so that the gap 172 in combination with the first recess 158 and the second recess 162 form a nook 178 that is configured to receive a shoulder portion of a user, as will become more apparent with respect to FIG. 5.

Figure 2:
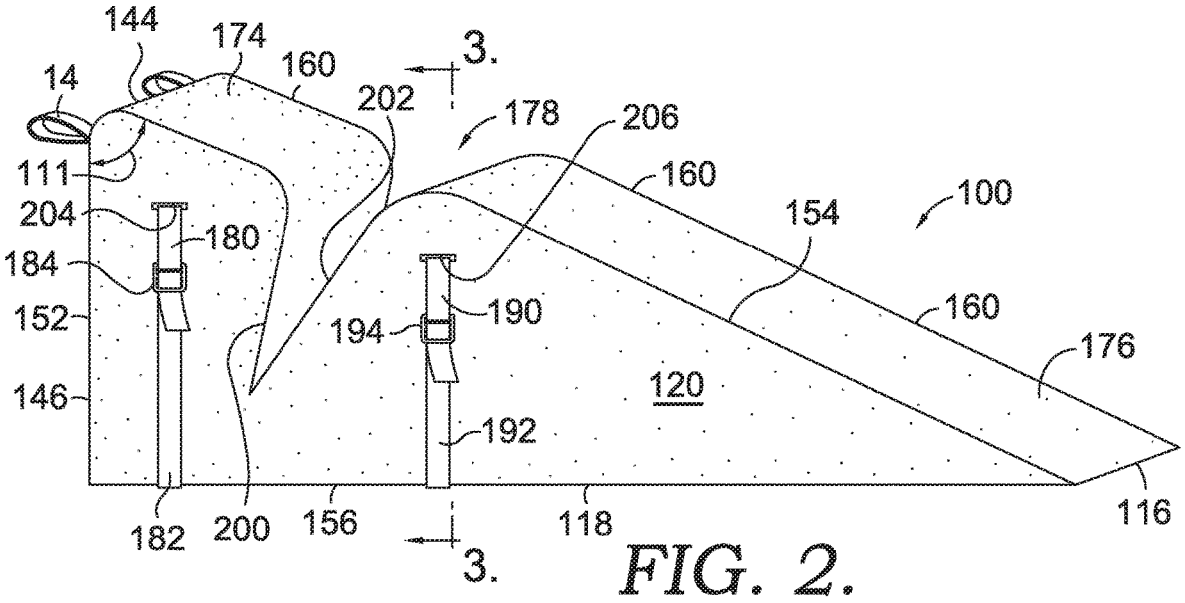
FIG. 2 illustrates a side view of the wedge shaped unitary lateral support cushion in a first state, in accordance with aspects herein.
Figure 3:
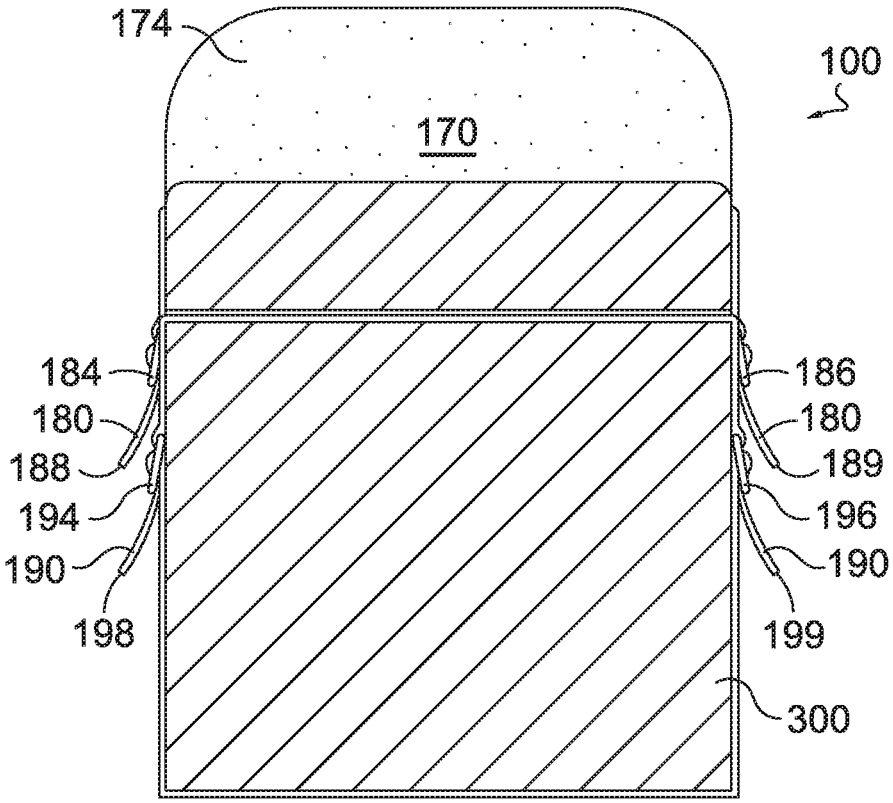
FIG. 3 illustrates a front cross-sectional view of the wedge shaped unitary lateral support cushion in accordance with aspects herein, taken at the line 3-3 indicated in FIG. 2.
Figure 4A:
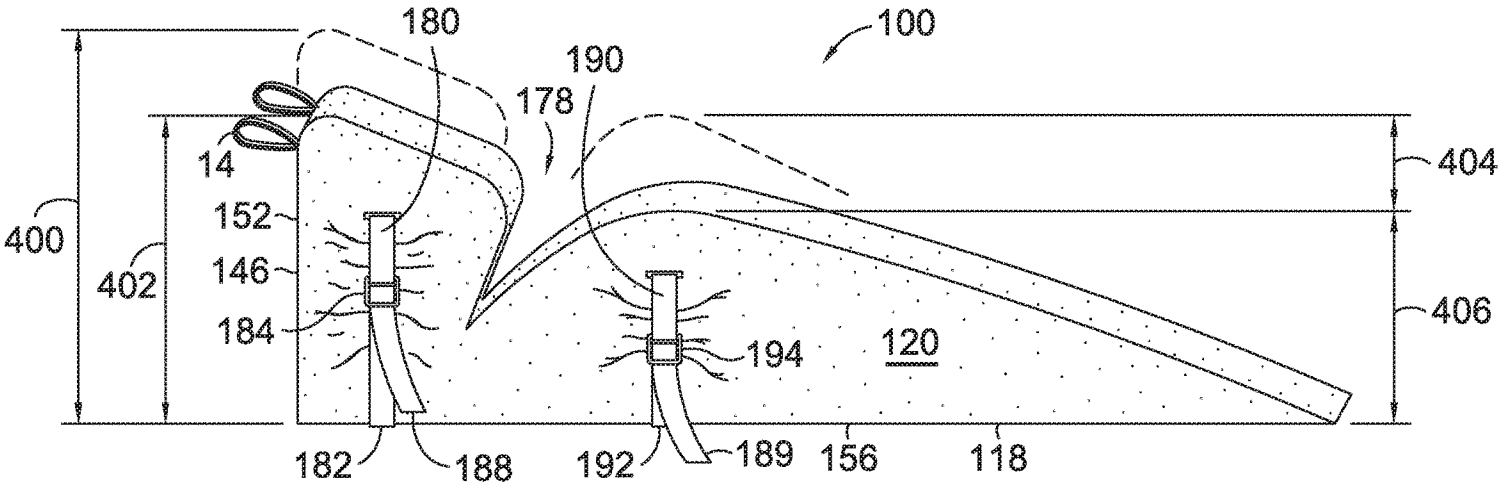
FIG. 4A illustrates a side view of the wedge shaped unitary lateral support cushion in a second state, in accordance with aspects herein.

As shown more clearly in FIGS. 2 and 3, the wedge shaped unitary lateral support cushion 100 in accordance with aspects herein may comprise a height adjustment mechanism comprised of one strap or two straps. In the case where the height adjustment mechanism comprises two straps, the height adjustment mechanism may be comprised of a first strap 180 and a second strap 182 proximate to a first side 200 of the nook 178. The first strap 180 may be configured to be threaded through or pass through a passage 204 extending from an upper portion of the first side plane 120 to the second side plane 122. In other words, a first end 188 of the first strap 180 may exit through the upper portion of the first side plane 120, and a second end 189 of the first strap 180 may exit through the upper portion of the second side plane 122 when threaded through the passage 204. The second strap 182 on the other hand, may be configured to extend over an exterior surface of the wedge shaped unitary lateral support cushion 100 over the first side plane 120, over the second side plane 122, and under the base plane 110. A first adjustment buckle 184 may be affixed to either the first end 188 of the first strap 180, or a first end (not shown) of the second strap 182 (as shown), and a second adjustment buckle 186 may be affixed to either the second end 189 of the first strap 180, or a second end (not shown) of the second strap 182 (as shown). When the first adjustment buckle 184 and the second adjustment buckle 186 are affixed to the second strap 182, as shown, the first end 188 of the first strap 180 may be adjustably coupled to the first adjustment buckle 184 and second end 189 of the first strap 180 may be adjustably coupled to the second adjustment buckle 186. In order to adjust the height of the wedge shaped unitary lateral support cushion 100 proximate the first portion 174 of the inclined plane 170 from a first height 400 to a second reduced the height 402, as shown in FIG. 4A, a user may simply pull down on the first end 188 and the second end 189 of the first strap 180 and allow the first strap 180 to lock/grip it in place with the first adjustment buckle 184 and the second adjustment buckle 186, respectively. The height adjustment is reversible since a user may simply loosen the first strap 180 from the grip of the first adjustment buckle 184 and the second adjustment buckle 186. It is to be understood that a height of the first portion 174 of the inclined plane 170 does not have to be evenly adjusted. In other words, a user may pull the first end 188 of the first strap 180 to a greater extent than the second end 189 of the first strap 180, or vice versa to reversibly adjust the height of the wedge shaped unitary lateral support cushion 100 so that it is shorter proximate the first side plane 120 than proximate the second side plane 122, or vice versa. In other words, the height of the first portion 174 of the inclined plane 170 of wedge shaped unitary lateral support cushion 100 is adjustable at any position along the length of the first strap 180 extending between the first end 188 and the second end 189. Although not shown, it is also contemplated that the first strap 180 and the third straps 190 may be placed over the first portion 174 and the second portion 176, respectively of the inclined plane 170, without departing from aspects herein. Further, it is also contemplated that the first strap 180 and the second strap 182 may be comprised of a first single strap, and similarly the third strap 190 and the fourth strap 192, may also be comprised of a second single strap.

Figure 4B:
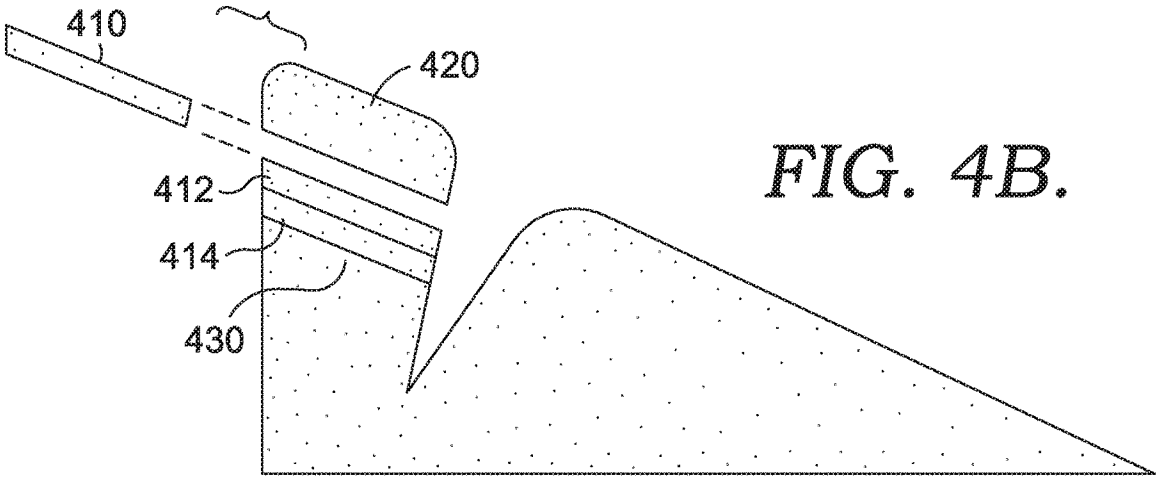
FIG. 4B illustrates a side view of the wedge shaped unitary lateral support cushion illustrating an alternative height adjustment mechanism.

Alternatively, the height of the first portion 174 of the wedge shaped unitary lateral support cushion 100 may be adjusted by providing one or more removable inserts (e.g., 410, 412, and 414) configured to fit between a pillow portion 420, and a base portion 430 of the first portion 174 of the wedge shaped unitary lateral support cushion 100, as shown in FIG. 4B. The removable inserts may be comprised of the same material as the wedge shaped unitary lateral support cushion 100, or a different material having a greater firmness than, for example, the pillow portion 420. As shown, when more than one insert is provided, the inserts are configured to be stackable to conform to the desired shape of the first portion 174. Once a desired height is achieved for the first portion 174 of the wedge shaped unitary lateral support cushion 100, the wedge shaped unitary lateral support cushion 100 may be provided with a removable cover (as discussed with reference to FIGS. 6A-6F), which secures the one or more inserts in place. Alternatively or in addition, each insert may be provided with a non-planar stacking surface that complements the stacking surfaces of the pillow portion 420 and the base portion 430 so as to prevent shifting (e.g., providing a foam insert having an egg crate surface).

As further shown in FIGS. 2 and 3, the height adjustment mechanism of the wedge shaped unitary lateral support cushion 100 may be further comprised of a third strap 190 and a fourth strap 192 proximate to a second side 202 of the nook 178. The third strap 190 may be configured to pass through a passage 206 extending from an upper portion of the first side plane 120 to the second side plane 122. In other words, a first end 198 of the third strap 190 may exit through the upper portion of the first side plane 120, and a second end 199 of the third strap 190 may exit through the upper portion of the second side plane 122 when threaded through the passage 206. The fourth strap 192 on the other hand, may be configured to extend over an exterior surface of the wedge shaped unitary lateral support cushion 100 over the first side plane 120, over the second side plane 122, and under the base plane 110. A third adjustment buckle 194 may be affixed to either the first end 198 of the third strap 190, or a first end (not shown) of the fourth strap 192 (as shown), and a fourth adjustment buckle 196 may be affixed to either the second end 199 of the third strap 190, or a second end (not shown) of the fourth strap 192 (as shown). When the third adjustment buckle 194 and the fourth adjustment buckle 196 are affixed to the fourth strap 192, as shown, the first end 198 of the third strap 190 may be adjustably coupled to the third adjustment buckle 194 and second end 199 of the third strap 190 may be adjustably coupled to the fourth adjustment buckle 196. In order to adjust the height of the wedge shaped unitary lateral support cushion 100 proximate the second portion 176 of the inclined plane 170 from a first height 404 to a second reduced the height 406, as shown in FIG. 4, a user may simply pull down on the first end 198 and the second end 199 of the third strap 190 and allow the third strap 190 to lock/grip it in place with the third adjustment buckle 194 and the fourth adjustment buckle 196, respectively. The height adjustment is reversible since a user may simply loosen the third strap 190 from the grip of the third adjustment buckle 194 and the fourth adjustment buckle 196. It is to be understood that a height of the second portion 176 of the inclined plane 170 does not have to be evenly adjusted either. In other words, a user may pull the first end 198 of the third strap 190 to a greater extent than the second end 199 of the third strap 190, or vice versa to reversibly adjust the height of the wedge shaped unitary lateral support cushion 100 so that it is shorter proximate the first side plane 120 than proximate the second side plane 122, or vice versa. In other words, the height of the second portion 176 of the inclined plane 170 of wedge shaped unitary lateral support cushion 100 is also adjustable at any position along the length of the third strap 190 extending between the first end 198 and the second end 199.

In the case where the adjustment mechanism is comprised of one strap, a first end of the strap (e.g., 180) may be coupled to an adjustment buckle (e.g. 184) and the other end of the strap may be threaded through the passage 204 that spans the width of the wedge shaped unitary lateral support cushion 100 from the first side plane 120 to the second side plane 122. Then, once the strap exits the passage 204, the strap may be extended over the second side plane towards the base plane 110, under the base plane 110 and over the first side plane 120, where it may be coupled to the adjustment buckle to adjust the height of the wedge shaped unitary lateral support cushion 100 by pulling on the second end of the strap. As shown in the figures, the heights of one or both of the first portion 174 and the second portion 176 may be adjusted using the one strap or two strap configurations described above.

Figure 5:
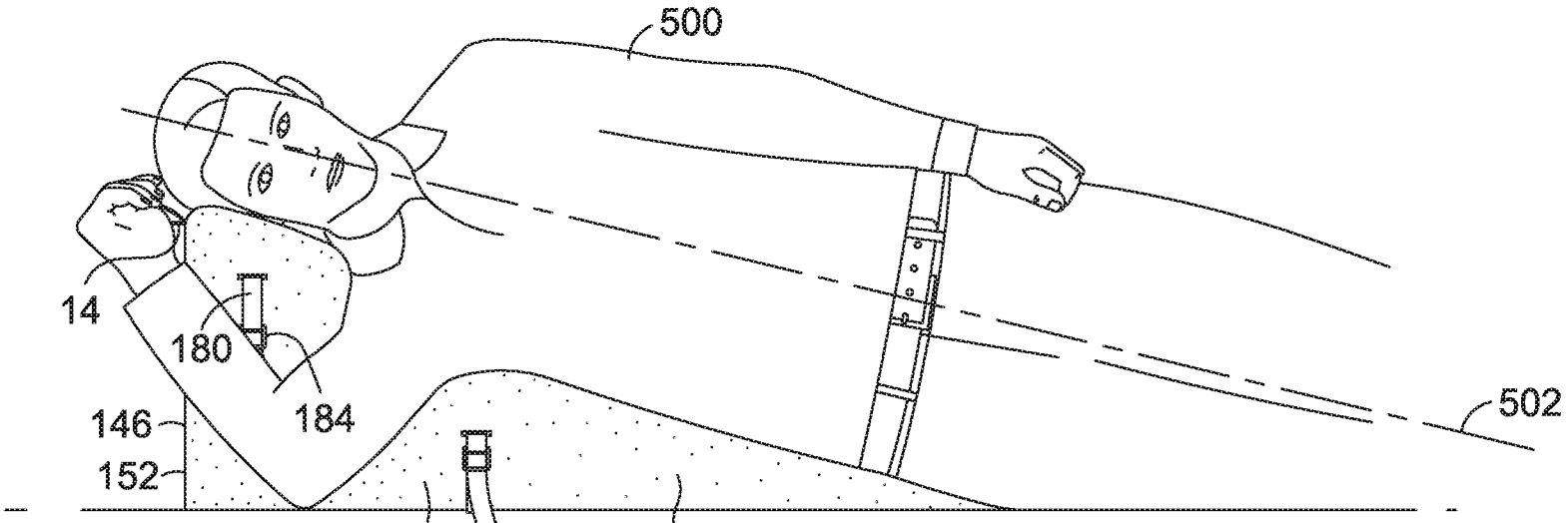
FIG. 5 illustrates a user being supported by the wedge shaped unitary lateral support cushion, in accordance with aspects herein.

FIG. 5 depicts a user 500 resting on his side supported by the wedge shaped unitary lateral support cushion 100, in accordance with aspects herein. As shown, the first portion 174 of the inclined plane 170 is configured to support a head of the user 500, while the shoulders of the user are comfortably supported and fitted into the nook 178, and while the upper torso area of the user is supported by the second portion 176 of the inclined plane 170. As shown, the wedge shaped unitary lateral support cushion 100 provides an ergonomic and comfortable side resting position to the user, that does not cause strain on the neck, the shoulders, or the back of the user 500. Specifically, the spine of the user is kept in a substantially straight from the head to hips of the user, as shown by the imaginary axis 502, which is difficult to achieve in a side resting position. Further, while the shoulder of the wearer is accommodated in the nook 178, the user has full range of motion of the arm corresponding to the shoulder that is in the nook 178. As such, the user 500 can remain in the side resting position for prolonged periods of time, and can also comfortably perform activities such as sleeping, watching TV, reading, cuddling with a partner, child, pet, pillow, and the like.

Further, the wedge shaped unitary lateral support cushion 100 may comprise one or more loop straps that can be used as finger loops/wrist loops or the like, and that may also be used as carrying straps and/or resting/stretching straps. For example, if only one loop strap is provided, the loop strap may be positioned proximate to a midpoint 145 of the rear superior edge 144 of the rear plane 140. Alternatively, as shown, loop straps 14 and 16, as shown in FIG. 1A, may be provided proximate to the first vertex 147 and the second vertex 149, respectively of the rear superior edge 144. The loop straps 14 and 16 may be made adjustable so that they can accommodate one or more fingers of the wearer or a wrist of the user to support the arm of the user that is wedged in the nook 178 of the wedge shaped unitary lateral support cushion 100 when in use, or the loop straps 14 and 16 may be used to transport the wedge shaped unitary lateral support cushion 100 for one location to another.

In accordance with aspects herein, the cushioning material 300 (shown in FIG. 3) provided within the wedge shaped unitary lateral support cushion 100 may be comprised of foam materials such as, for example, polyurethane foam (regular grade, high density, high resiliency), latex foam, bio-hybrid foam, eco foam, cotton batting, cotton stuffing, polyester batting, polyester stuffing, synthetic batting, synthetic stuffing, memory foam, memory foam clusters, polyurethane foam clusters (regular grade, high density, high resiliency), and the like that is suitable in accordance with aspects herein.

Figure 6A:
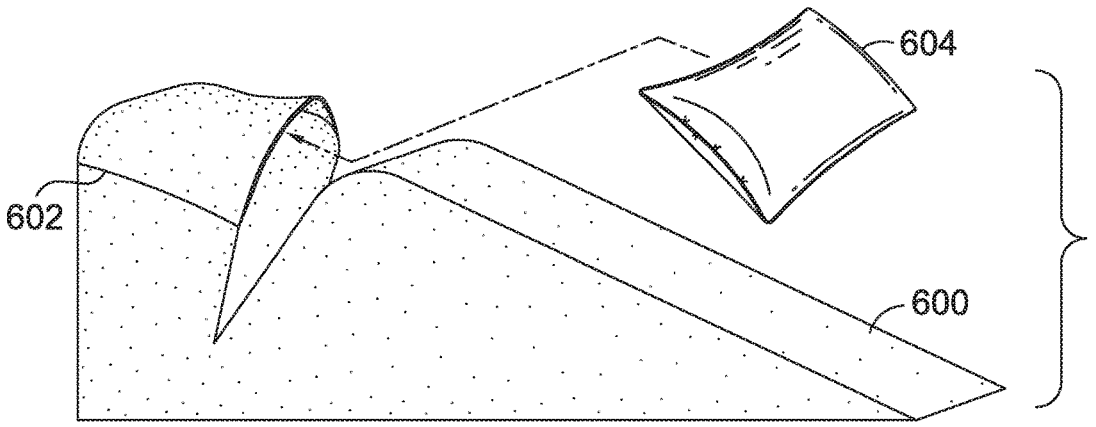
FIGS. 6A and 6B illustrate a cover for the wedge shaped unitary lateral support cushion, in accordance with aspects herein.
Figure 6B:
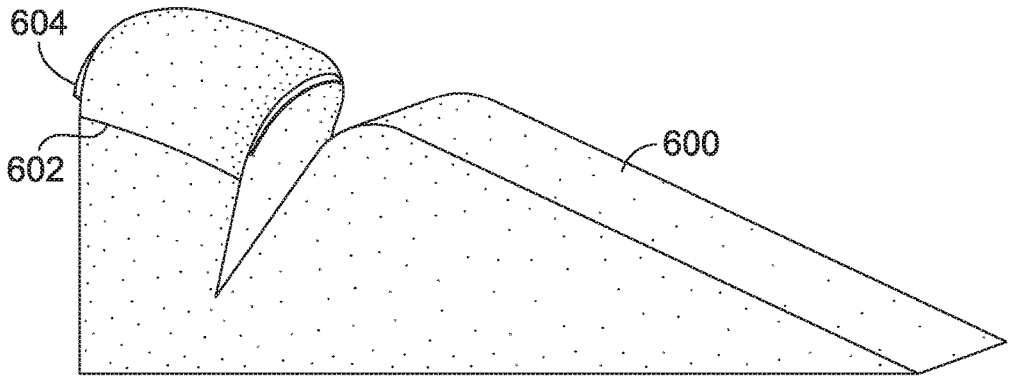

Additionally, as shown in FIGS. 6A and 6B, the wedge shaped unitary lateral support cushion 100 may further be provided with a removable cover 600 formed from a washable textile material, wherein the removable cover 600 is configured to closely follow the contours of the wedge shaped unitary lateral support cushion 100. The washable textile material may be breathable and may comprise one or more of heat management properties, moisture management properties, anti-bacterial properties, anti-odor properties, and the like. Some materials suitable for the fabric used to manufacture the cover may include polyester, nylon, cotton, hemp, microfiber, elastane, or a combination thereof. Further, the removable cover 600 may optionally include a closeable pocket 602 proximate to the first portion 174 of the wedge shaped unitary lateral support cushion 100 for receiving a removable pillow 604, as shown in FIG. 6A. The removable pillow 604 may be made of hypoallergenic materials and constructed from a light weight breathable fabric such as, for example, a muslin fabric. Further, the removable pillow 604 may be filled with synthetic fibers, down, or foam and may be configured to provide a softer resting surface to the head of the user as shown in FIG. 6B, for example, the user 500 (as shown in FIG. 5). Alternatively, the pocket for accommodating the removable pillow 604 may be provided on a surface of the first portion 174 (not shown) of the wedge shaped unitary lateral support cushion 100. In this configuration, the removable cover 600 may extend over both the wedge shaped unitary lateral support cushion 100 and the removable pillow 604.

Figure 6C:
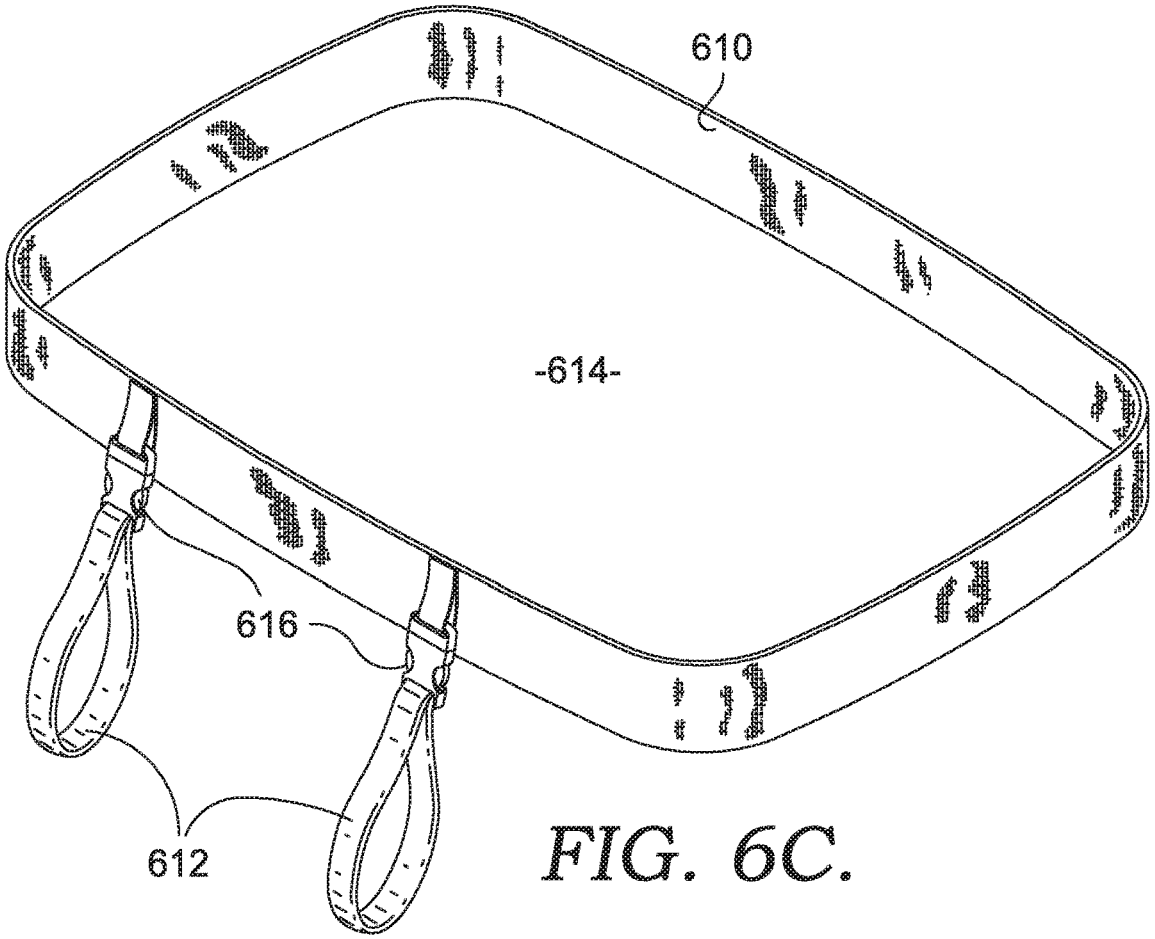
FIG. 6C illustrates a cushion band accessory for the wedge shaped unitary lateral support cushion having a pair of support wrist straps, in accordance with aspects herein.
Figure 6D:
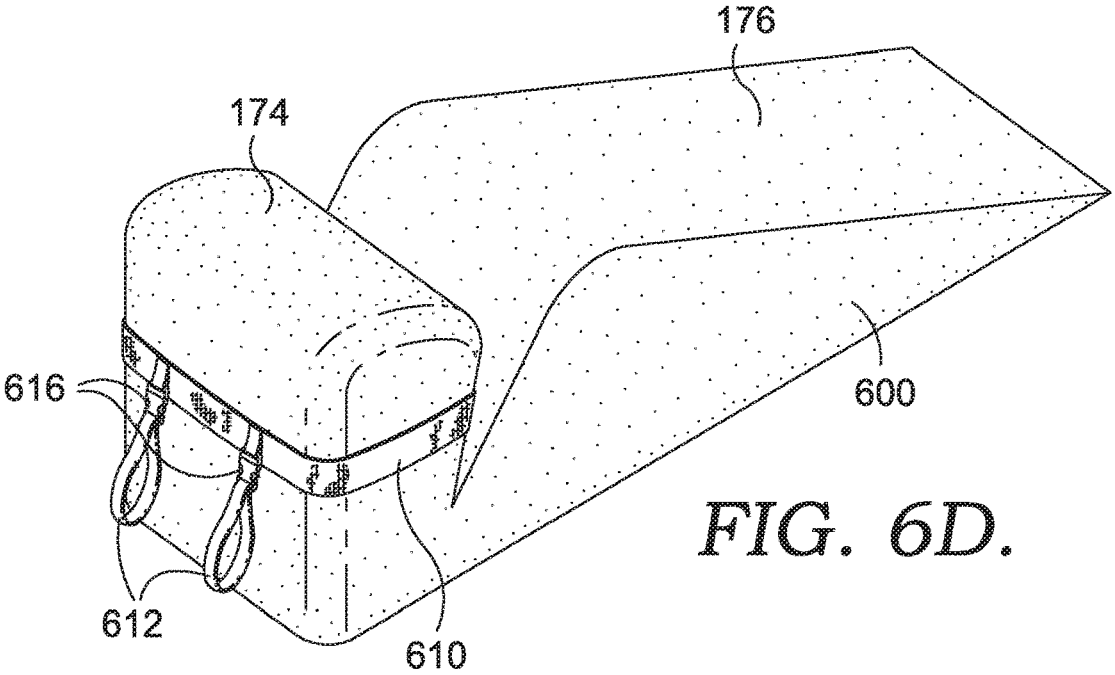
FIG. 6D illustrates the cushion band accessory shown in FIG. 6C as applied to the wedge shaped unitary lateral support cushion.
Figure 6E:
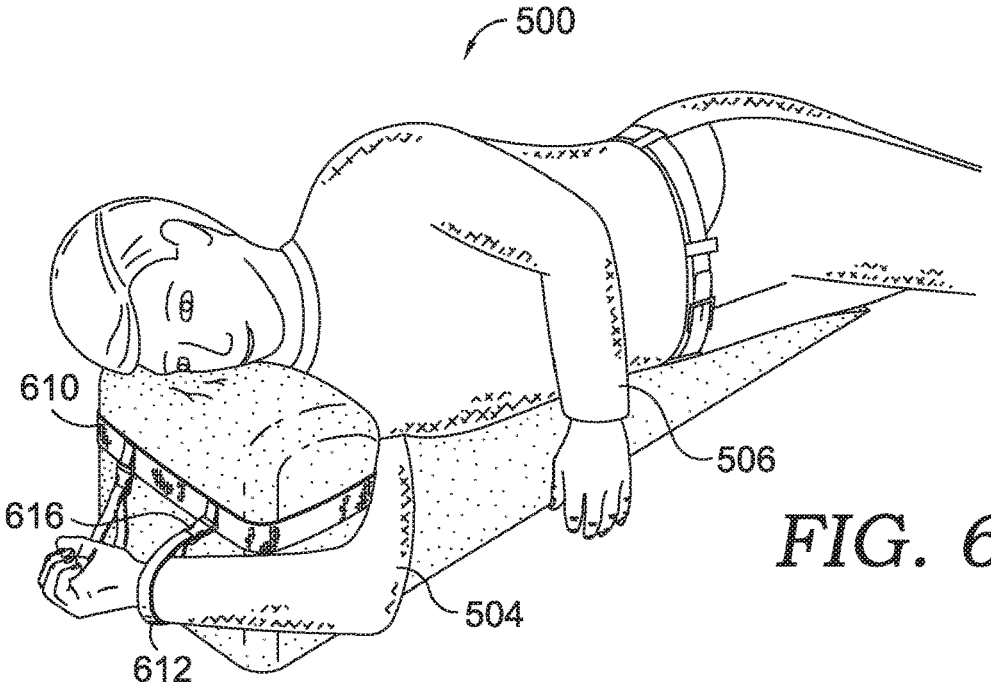
FIG. 6E illustrates a user being supported by the wedge shaped unitary lateral support cushion and the cushion band accessory shown in FIG. 6D.

As illustrated in FIG. 5, the non-cuddling arm of the user 500 may be supported by inserting one or more fingers of the wearer through the loop straps 14 and 16. The loop straps 14 and 16 may be configured to extend through slits or openings (not shown) in the removable cover 600 such that the user 500 can use the loop straps 14 and 16 as depicted in FIG. 5. Alternatively, as shown in FIG. 6C, the wedge shaped unitary lateral support cushion 100 may be provided with a cushion band accessory 610. The cushion band accessory 610 includes a pair of support wrist straps 612. The support wrist straps 612 may be detachable by using, for example, a side release buckle 616 for each support wrist strap of the pair of support wrist straps 612, as shown, or any other suitable release mechanism. Alternatively, the pair of support wrist straps 612 may be permanently affixed to the cushion band accessory 610 (not shown). The cushion band accessory 610 may be elastic and may be configured to hug the first portion 174 as the first portion 174 is inserted through the opening 614 of the cushion band accessory 610. As it is to be understood, the cushion band accessory 610 may be used directly over the wedge shaped unitary lateral support cushion 100 or over the removable cover 600, as shown in FIG. 6D. As shown in FIG. 6E, the user 500 may place the cushion band accessory 610 at a desired height along the first portion 174 such that the user 500 may insert his/her non-cuddling upper extremity 504 through one of the pair of support wrist straps 612 for improved comfort and enhanced posture such that the non-cuddling upper extremity 504 does not sit in an uncomfortable position that would cause strain to for example the shoulder portion of the non-cuddling upper extremity 504 of the user 500. The cuddling upper extremity 506 is free to lay on the side of the user 500, as shown in FIG. 6E, or to cuddle another person or object positioned in front of them.

Figure 6F:
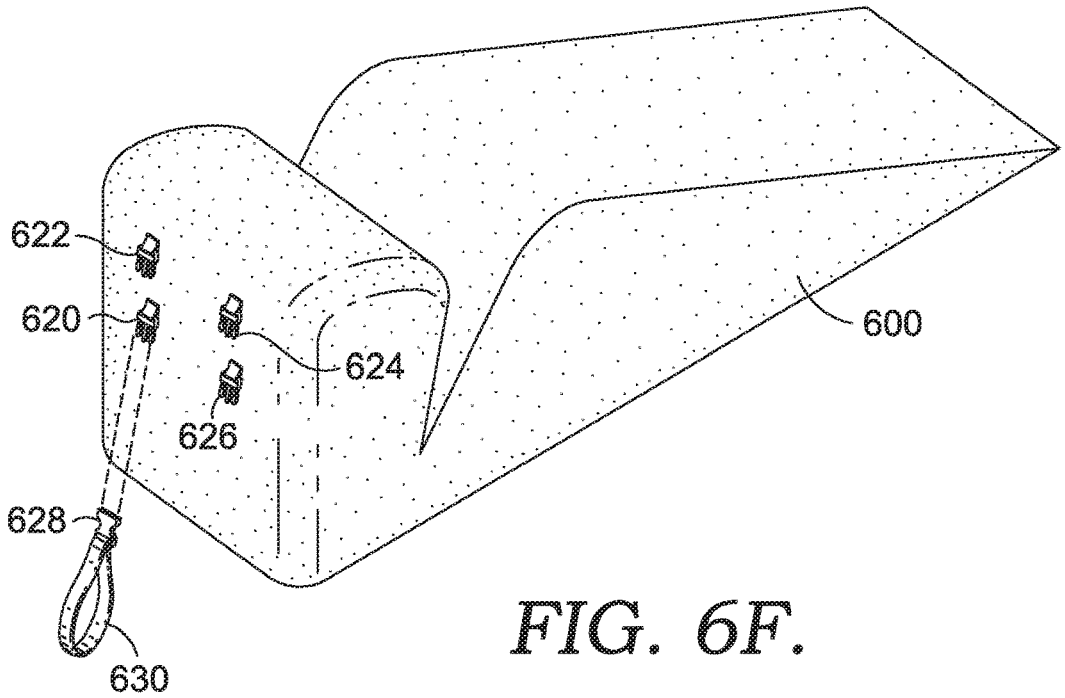
FIG. 6F illustrates another embodiment where a moveable support wrist strap is provided as an accessory for the wedge shaped unitary lateral support cushion, in accordance with aspects herein.

FIG. 6F depicts another embodiment for which a movable support wrist strap 630 is provided. According to this embodiment, the wedge shaped unitary lateral support cushion 100 itself, may comprise a plurality of female or male components of a releasable connector, for example, a side release buckle, (e.g., male component 620, male component 622, male component 624, and male component 626, as shown) arranged and affixed to the rear plane (rear plane 140 shown in FIG. 1B), or alternatively, the plurality of female or male components may be arranged and affixed to a portion 640 of the removable cover 600 that aligns with the rear plane 140 of the wedge shaped unitary lateral support cushion 100, as shown. The movable support wrist strap 630 may be provided with the complementary component female or male component (e.g., female component 628) that is configured to mate or otherwise be fixed to a chosen complementary female or male component in the plurality of female or male components provided on the rear plane 140 of the wedge shaped unitary lateral support cushion 100, or the portion 640 of the removable cover 600. The female or male components affixed to the rear plane 140 or the portion 640 may be arranged at different heights proximate to the lateral edges of the rear plane 140 so that the user (e.g., user 500) may select a desired position for the movable support wrist strap 630 that provides him/her, the most comfort. Although only four positions are shown in FIG. 6F, it is contemplated that more positions may be provided depending on the amount of adjustability desired for the movable support wrist strap 630.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different applications are available for the invention without departing from the scope thereof, it is to be understood that all matter herein set forth or shown in the accompanying drawings is to be interpreted as illustrative and not in a limiting sense.

The invention claimed is:

1. A wedge shaped unitary lateral support cushion comprising:

a base plane comprising a first vertex, a second vertex, a third vertex, and a fourth vertex, wherein a first edge of the base plane extends between the first vertex and the second vertex, a second edge of the base plane extends from the second vertex to the third vertex, a third edge of the base plane extends from the third vertex to the fourth vertex, and a fourth edge of the base plane extends from the fourth vertex to the first vertex;

a rear plane having a rear inferior edge, a rear superior edge, a rear first side edge, and a rear second side edge, the rear plane upwardly extending from the first edge of the base plane with the rear inferior edge abutting the first edge of the base plane;

a first side plane having a first side edge, a first side inclined edge having a first recess proximate to the first side edge, and a first side inferior edge, the first side plane upwardly extending from the fourth edge of the base plane, the first side inferior edge abutting the fourth edge of the base plane and the first side edge abutting the rear first side edge of the rear plane;

a second side plane having a second side edge, a second side inclined edge having a second recess proximate to the second side edge, and a second side inferior edge, the second side plane upwardly extending from the second edge of the base plane, the second side inferior edge abutting the second edge of the base plane and the second side edge abutting the rear second side edge of the rear plane;

an inclined plane having a gap between a first portion and a second portion, the inclined plane abutting the third edge of the base plane, the rear superior edge of the rear plane, the first side inclined edge of the first side plane, and the second side inclined edge of the second side plane, the gap aligning with the first recess of the first side plane and the second recess of the second side plane;

a first strap proximate a first side of the gap, wherein the first strap extends through a passage extending through an upper area of the first portion, through the first side plane and through the second side plane;

a second strap having a first end of the second strap affixed to a first adjustment buckle and a second end of the second strap affixed to a second adjustment buckle, wherein the first adjustment buckle is adjustably coupled to the first end of the first strap and the second adjustment buckle is adjustably coupled to the second end of the first strap;

the second strap extending from the first adjustment buckle downward over the first side plane, under the base plane, and upward over the second side plane to the second adjustment buckle;

a third strap proximate a second side of the gap, wherein the third strap extends through a passage extending through an upper area of the second portion, through the first side plane and through the second side plane;

a fourth strap having a first end of the fourth strap affixed to a third adjustment buckle and a second end of the fourth strap affixed to a fourth adjustment buckle, wherein the third adjustment buckle is adjustably coupled to the first end of the third strap and the fourth adjustment buckle is adjustably coupled to the second end of the third strap; and the fourth strap extending from the third adjustment buckle downward over the first side plane, under the base plane, and upward over the second side plane to the fourth adjustment buckle.

2. The wedge shaped unitary lateral support cushion of claim 1, wherein the gap of the inclined plane in combination with the first recess of the first side plane and the second recess of the second side plane cooperate to form a nook.

3. The wedge shaped unitary lateral support cushion of claim 2, wherein the nook is configured to receive a shoulder area of a user when the wedge shaped unitary lateral support cushion is used by a user to lay down on a user's side.

4. The wedge shaped unitary lateral support cushion of claim 1, wherein the first portion of the inclined plane is configured to support a head of a user, and wherein the second portion of the inclined plane is configured to support an upper torso area of the user.

5. The wedge shaped unitary lateral support cushion of claim 1, wherein the first strap and the second strap cooperate with each other to reversibly adjust a height of the first portion of the wedge shaped unitary lateral support cushion, and wherein the third strap and the fourth strap cooperate with each other to reversibly adjust a height of the second portion of the wedge shaped unitary lateral support cushion proximate the gap.

6. The wedge shaped unitary lateral support cushion of claim 1, further comprising a loop strap proximate to a midpoint of the rear superior edge of the rear plane.

7. The wedge shaped unitary lateral support cushion of claim 1, further comprising a pair of loop straps proximate to a first upper vertex and a second upper vertex, respectively, of the rear superior edge of the rear plane.

8. The wedge shaped unitary lateral support cushion of claim 1, further comprising a cushion band accessory comprising at least one wrist strap.

* * * * *